United States Patent [19]

Cox

[11] Patent Number: 4,678,864

[45] Date of Patent: Jul. 7, 1987

[54] MASS TERMINABLE FLAT CABLE ASSEMBLY WITH READILY SEPARABLE GROUND PLANE

[75] Inventor: Albert R. Cox, Centerville, Ind.

[73] Assignee: Cooper Industries, Inc., Houston, Tex.

[21] Appl. No.: 750,523

[22] Filed: Jun. 27, 1985

[51] Int. Cl.[4] ..... H01B 7/08; H01B 7/34

[52] U.S. Cl. ..... 174/36; 156/289; 156/290; 174/115; 174/117 F; 428/352

[58] Field of Search ..... 174/115, 117 F, 117 FF, 174/117 PC; 156/289, 290; 428/352

[56] References Cited

U.S. PATENT DOCUMENTS

| | | | |
|---|---|---|---|
| 2,940,884 | 6/1960 | White | 352/244 X |
| 2,964,587 | 12/1960 | Minot | 174/117 |
| 3,173,991 | 3/1965 | Breakfield, Sr. | 174/117 |
| 3,179,904 | 4/1965 | Paulsen | 333/1 |
| 3,226,473 | 12/1965 | Dahlgren | 174/117 FF |
| 3,508,754 | 4/1970 | Shorin | 156/289 X |
| 3,554,835 | 1/1971 | Morgan | 156/289 X |
| 3,612,744 | 10/1971 | Thomas | 174/117 FF X |
| 3,728,661 | 4/1973 | Kassabgi | 174/117 F X |
| 3,788,941 | 1/1974 | Kupits | 156/289 X |
| 4,045,607 | 8/1977 | Swearingen et al. | 428/200 |
| 4,226,903 | 10/1980 | Gottung et al. | 428/195 |
| 4,241,198 | 12/1980 | Kobayashi | 428/352 X |
| 4,294,786 | 10/1981 | Graham et al. | 156/289 X |
| 4,304,815 | 12/1981 | Cugasi, Jr. | 428/352 X |
| 4,460,804 | 7/1984 | Svejkovsky | 174/117 A |
| 4,513,170 | 4/1985 | Apodaca | 174/117 F X |

*Primary Examiner*—Morris H. Nimmo

*Attorney, Agent, or Firm*—Fitch, Even, Tabin & Flannery

[57] ABSTRACT

A flat cable assembly for use with a mass termination connector. The cable assembly includes a main cable having a plurality of conductors held in regularly spaced parallel relationship in a sheet of insulation to match the terminal element spacing of the connector. The main cable has a first surface, a second surface and lateral ends with the surfaces extending between the ends. A plastic covering having an interior surface facing the main cable second surface is provided. A release agent is printed on either or both of the interior surface of the plastic covering and the second surface of the main cable so that portions of the printed upon surface are coated by the release agent and other portions of that surface are uncoated. A metallic ground plane is positioned between the main cable and the covering with the plastic covering being bonded to the second surface at the uncoated portions so that the plastic covering can be readily separated from the main cable to expose the ground plane.

10 Claims, 3 Drawing Figures

MASS TERMINABLE FLAT CABLE ASSEMBLY WITH READILY SEPARABLE GROUND PLANE

The present invention relates to electrical wiring components and, more specifically, to a flat cable assembly having an integral ground plane, for use with mass termination, insulation displacement connectors.

BACKGROUND OF THE INVENTION

Mass termination, insulation displacement connectors have come into increasing commercial prominence because of the significant savings in time and labor they offer compared to stripping and individually terminating each conductor using a crimp terminal. These connectors have an insulative body holding a number of regularly spaced terminal elements having slotted plates terminating in sharpened free ends extending beyond a surface of the body. The conductors also include covers having recesses in a facing surface for receiving the free ends of the plates. After the insulated conductors are aligned with their corresponding slotted plates, relative closing of the body and cover results in displacement of the insulation with the conductors contacting the metallic plates. For further information regarding the operation and structure of such connectors, reference may be made to U.S. Pat. Nos. 4,458,967 and 3,912,354.

The most efficient form of conductors for use with such connectors is the flat cable in which conductors, running parallel and spaced to match the spacing of the terminal elements in the connector, are held by a layer of insulation. The use of a flat cable avoids running the conductors one at a time and holding them in position for termination. The flat cable can be used for either a daisy chain connection (where the connector is applied intermediate the cable ends) or an end connection. The sharpened ends of the slotted plates pierce the web material between the conductors in the flat cable as the body and cover close so slitting of the cable between conductors is not required.

In certain applications, it is advantageous to incorporate in the flat cable a metallic ground plane having a width such that it extends beyond the discrete conductors. But for the presence of the ground plane, the impedance and capacitance of the flat cable could vary in accordance with its proximity to metallic structure. The use of a ground plane stabilizes and reduces impedance and, furthermore, functions to reduce crosstalk among the various conductors, which crosstalk could adversely affect the operation of computers and peripheral equipment. Heretofore, the ground plane typically was embedded in the layer of insulation along with the conductors. Special powered tools were required to cut the insulation to permit access to the ground plane so that it could be peeled away from the conductors to prepare for their mass termination. If the removal of the ground plane was done improperly, the electrical and dimensional characteristics of the cable could be adversely affected.

It is known to releasably connect a stack of flat cables with a perforated separator strip disposed between each pair of cables. By the application of heat and pressure, the cables bond at the perforations. The limited adhesion holds the cables joined until manual separation is desired. For further information regarding the operation and structure of such cables, reference may be made to U.S. Pat. No. 3,173,991.

It is also known to provide a tape conductor including a conductive strip sandwiched between a base layer having an adhesive coating facing away from the strip, and a cover layer with an adhesive coating for securing the tape to the base layer. By selective arrangement of adhesive patches, the peel force required to remove the cover layer can be varied. For further information concerning such a tape conductor, reference may be made to U.S. Pat. No. 2,964,587.

SUMMARY OF THE INVENTION

Among the various aspects and objects of the present invention may be noted the provision of an improved flat cable assembly incorporating a ground plane. The flat cable assembly includes a cover for the ground plane which can be manually removed, without the use of special tools, to expose the ground plane and permit its deflection from the main cable, to prepare the main cable for mass termination. The flat cable assembly of the present invention has substantially the same thickness as prior flat cables including integral ground planes and also has substantially the same weight per unit length. The flat cable assembly is reliable in use, has long service life and is easy and economical to manufacture. Other aspects and features of the present invention will be, in part, apparent and, in part, pointed out specifically hereinafter in the following specification and the attached claims and drawings.

Briefly, the flat cable assembly of the present invention includes a main flat cable having a plurality of conductors held in regularly spaced, parallel relationship in a sheet of insulation to match the terminal element spacing of the mass termination connector. The main cable has a first surface, a second surface, and lateral edges with the surfaces extending between the lateral ends. A plastic covering has an interior surface facing the cable second surface with a release agent printed in a pattern on the interior surface so that portions of the interior surface are coated by the release agent and other portions of the interior surface are uncoated. The cable assembly also includes a metallic ground plane positioned between the main cable and the covering, with the covering being bonded to the second cable surface at uncoated portions of the interior surface so the plastic covering can be readily removed to expose the ground plane.

BRIEF DESCRIPTION OF THE DRAWINGS

Corresponding reference numbers indicate corresponding components throughout the several views of the drawings.

DESCRIPTION OF THE PREFERRED EMBODIMENT

Figure 1:
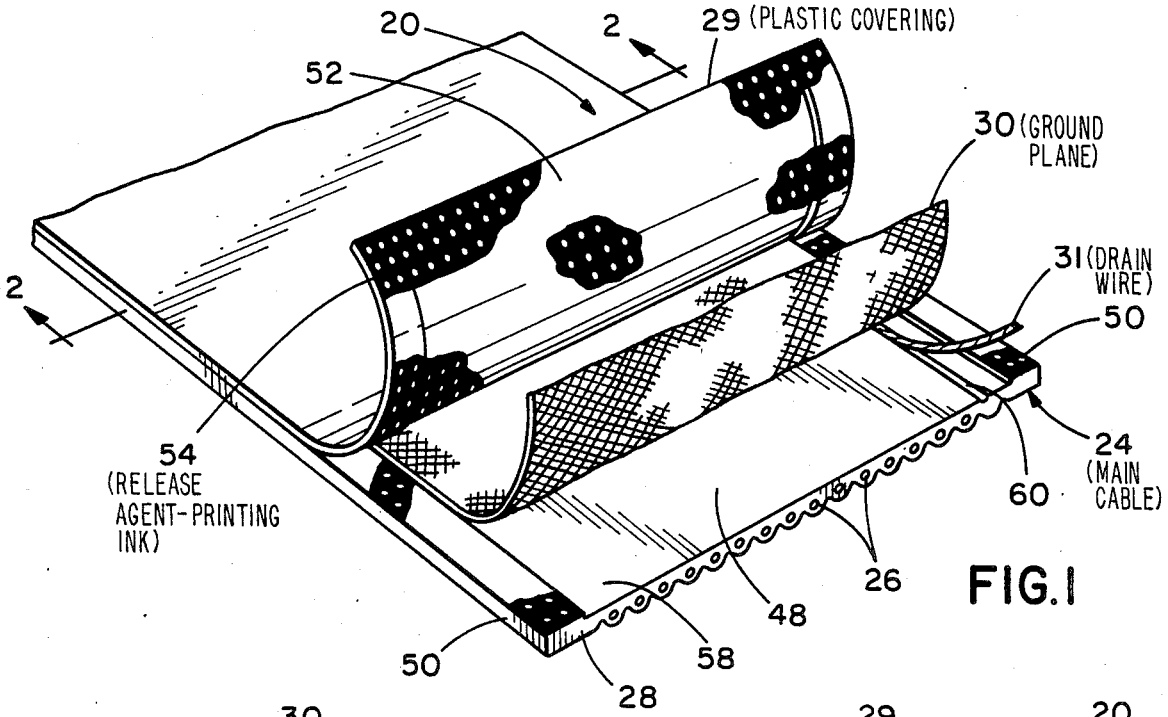
FIG. 1 illustrates a flat cable assembly embodying various features of the present invention with the various components of the assembly separated.

Referring now the drawings, a flat cable assembly of the present invention adapted for use with a mass termination, insulation displacement connector 22 (shown in FIG. 3), is generally indicated by reference numeral 20. The flat cable assembly 20 is of laminated construction and includes a main cable 24 including a plurality of conductors 26 held in regularly spaced, parallel relationship in a layer of insulation 28. The cable assembly 20 includes a plastic covering 29 with a ground plane conductor 30 sandwiched between the main cable and the plastic covering. A drain wire 31, in intimate contact with the ground plane 30, may also be included in the cable assembly. While the particular flat cable illustrated is intended for carrying electrical signals and has the conductors on 0.050 inch centers, it will be appreciated that the flat cable 20 of the present invention can be made in larger sizes for use in supplying electrical power to various electrical components.

Figure 3:
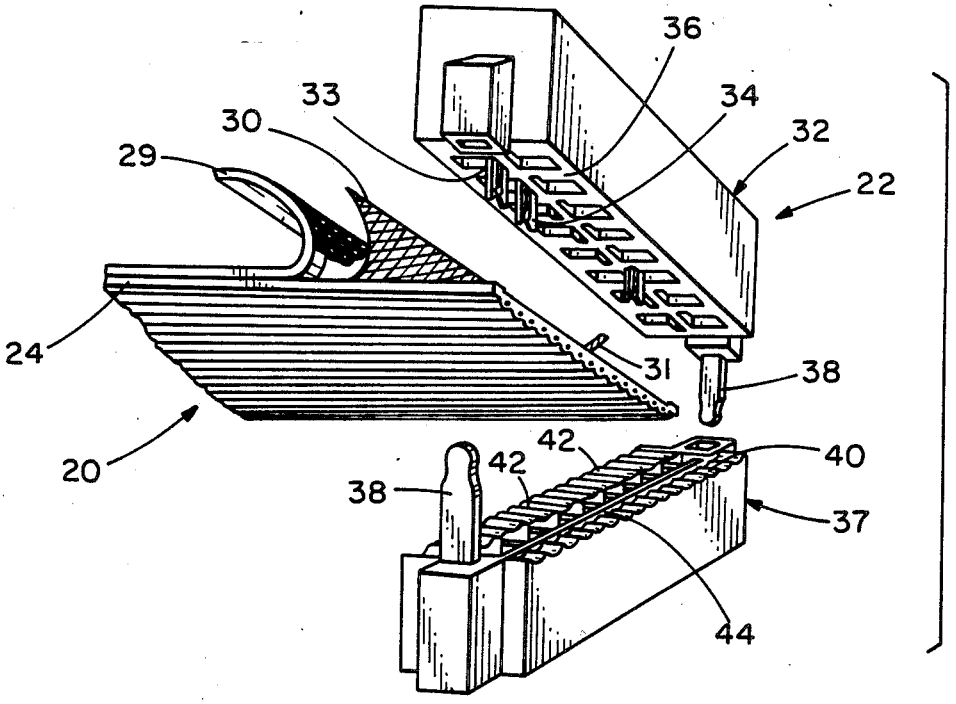
FIG. 3 is an exploded perspective view showing a mass termination, insulation displacement connector usable with the cable assembly of FIG. 1.

The mass termination connector 22 shown in FIG. 3 is of the high terminal density, signal conductor type and includes an insulative body 32 having two rows of terminal element cavities. A terminal element 33 is disposed in each cavity with elements in each row having a 0.100 inch pitch. Adjacent terminal elements in each row are staggered so that every other conductor 26 is terminated by elements in one row while the remaining conductors are terminated by the elements in the other row. Each terminal element includes a slotted plate 34 extending beyond a surface 36 of the body with the plate terminating in sharpened ends for piercing the web material of the flat cable between the conductors. The plate edges defining the slot function to displace the insulation material so that by forcing a conductor 26 into a slotted plate 34, the conductor is engaged by the metallic plate to establish an electrical circuit. The connector 22 also includes a cover 37 held in alignment with the body 32 by means of pins 38. The cover, also formed of insulating material, includes a facing surface 40 having pockets 42 for locating the flat cable conductors 26 with respect to the terminal elements 33, and a recess 44 for receiving the free ends of the slotted plates 34. Thus, after the flat cable 20 is positioned between the cover 37 and the body 32, relative closing of the two results in mass termination of the conductors 26 of the flat cable 20.

Figure 2:
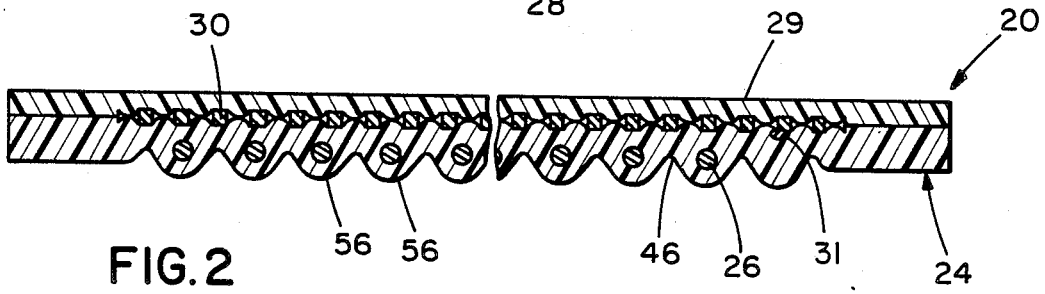
FIG. 2 is a cross-sectional view of the cable of FIG. 1.

Referring to FIGS. 1 and 2, the main cable 24 has a first surface 46 and a second surface 48 and lateral ends 50 with the first and second surfaces extending between the lateral ends. The plastic covering 29 has an interior surface 52, facing the cable second surface, which has a release agent 54 printed thereon so that portions of the interior surface are coated by the release agent and other portions of the interior surface remain uncoated. It will be appreciated that the release agent could be instead printed on the main cable second surface 48, or on both surface 52 and on surface 48. The release agent is shown as having been applied in a dot matrix form with the dots representing uncoated or bondable areas on the interior surface of the plastic coating. The application of heat and pressure will cause the plastic covering to become adhered to the main cable second surface 48 at the uncoated areas. More specifically, as well known to those of skill in art, heating the covering 29 and the second surface 48 of the main cable above their softening temperatures but below their melting temperatures, while applying pressure, results in adhesion by bonding or lamination. About 70% of the total surface area on the interior surface 52 is coated and there will be no bonding at these coated areas. Thus, the force required to peel away the plastic covering to expose the ground plane can be varied in accordance with the coverage of the release agent. Preferably the release agent takes the form of printing ink of the type usable on plastic such as polyvinyl chloride, which is the preferred material for the insulation layer 28 as well as the plastic covering 29. As is well known to those of skill in the art, an example of such ink is black vinyl ink sold by Gem Gravure Corporation of Massachusetts as Style 310, and as sold by Mathers Associates of Elk Grove Village, Ill. as MHP 310. While the release agent is shown as being applied in a dot matrix form, other arrangements of the printing would also be acceptable, for example, adjacent longitudinal or transverse strips of coated and uncoated portions. The great advantage of the use of the printed release agent is that the thickness and weight of the total flat cable assembly is not increased in any substantial way and the plastic covering can be peeled away to expose the metallic ground plane 30 without the use of any tools. Thus, preparation for termination of the flat cable assembly 20 is much simpler than with previous flat cables having integral ground planes wherein the ground plane was embedded in a layer of insulation along with the parallel conductors.

The first surface 46 of the main cable 24 is preferably undulating, having a plurality of spaced ridges 56 with one of the conductors 26 held in alignment with each ridge. The ridges 56 are received by the pockets 42 in the connector cover 37 to properly locate the various conductors 26 in alignment with their corresponding slotted plates 34. This is advantageous over a flat cable having flat sides because the connector does not have to be provided with alignment stops at the sides of the cover and/or body to position the flat cable in position for termination.

The second side 48 of the main cable preferably has a centrally located depression 58 in which the ground plane conductor 30, which is preferably of copper mesh construction, is nested. As the ground plane conductor 30 extends short of the lateral ends 50 of the main cable 24, the ground plane is protected, both mechanically and electrically, from inadvertent contact with metal structure. The uncoated portions of the interior surface 52 of the plastic covering 29 are bonded to the lateral portions of the main cable second surface 48 flanking the ground plane. The second surface 48 has a longitudinal groove 60 for seating the drain wire 31 so that it is held in intimate contact with the ground plane conductor 30 throughout the longitudinal extent of the flat cable assembly 20.

Operation of the flat cable assembly 20 of the present invention is as follows: In preparation for termination of the main cable 24, the plastic covering 29 is peeled away, either by hand or by the use of very simple tools. This predetermined, limited adhesion of the plastic covering to the main cable second surface 48 through the interstices of the copper mesh ground plane 30 and to the lateral portions of the second surface 48 of the main cable avoids the use of power tools which could exhibit sufficiently large forces to alter the dimensional and/or electrical characteristics of the cable.

As shown in FIG. 3, the ground plane conductor 30 is also peeled back away from the main cable. This is easily done because the ground plane 30 is a good conductor of heat. Thus, the heat and pressure applied in the fusion of the plastic covering to the main cable second surface 48 will not result in any substantial adhesion of the ground plane conductor 30 to the second surface 48. The insulation displacement mass termination connector 32 can then be closed about the main cable effecting termination of the various conductors 26 in their corresponding slotted plates 34. The ground plane conductor can then be connected to ground in a conventional manner or cut away.

In view of the above, it will be seen that the several objects of the invention are achieved and other advantageous results attained.

As various changes could be made in the above invention, it is intended that all matter contained in the above description or shown in the accompanying drawings shall be interpreted as illustrative and not in a limiting sense.

What is claimed is:

1. A flat cable assembly for use with a mass termination connector having a plurality of regularly spaced terminal elements, said flat cable assembly comprising:

a main cable including a plurality of conductors held in regularly spaced parallel relationship in a sheet of insulation to match the terminal element spacing of a connector having a plurality of regularly spaced terminal elements, said cable including a first surface, a second surface and lateral edges with said surfaces extending between said lateral edges;

a plastic covering having an interior surface facing said cable second surface, a release agent being printed on at least one of said interior surface and said second surface so that portions of the printed-upon surface are coated by said release agent and other portions of said printed-upon surface are uncoated, said flat cable assembly having lateral edges with the printing of said release agent extending to the lateral edges of said assembly, said printing of said release agent extending the entire width of said assembly so that said covering and said main cable are separated by said release agent the entire width of said assembly permitting manual stripping of said covering without the use of any tools or any cutting; and a metallic ground plane disposed between said main cable and said covering, said plastic covering being bonded to said second surface at said uncoated portions.

2. A flat cable assembly as set forth in claim 1 wherein said release agent is printing ink.

3. A flat cable assembly as set forth in claim 1 wherein said release agent is printed on said interior surface.

4. A flat cable assembly as set forth in claim 3 wherein the release agent is printed in a dot matrix form with the dots being the uncoated portions of said interior surface.

5. A flat cable assembly as set forth in claim 3 wherein about seventy percent of said interior surface is coated by said release agent.

6. A flat cable assembly as set forth in claim 1 wherein said first surface of said main cable has a plurality of spaced ridges with one of said conductors held in alignment with each ridge.

7. A flat cable assembly as set forth in claim 1 further comprising a drain wire engaging said ground plane.

8. A flat cable assembly as set forth in claim 3 wherein said ground plane extends intermediate but short of said lateral edges of said main cable, said second surface having a central depression in which said ground plane is nested.

9. A flat cable as set forth in claim 8 wherein uncoated portions of said interior surface of said plastic covering are bonded to the lateral portions of said main cable second surface flanking said ground plane.

10. A flat cable as set forth in claim 1 wherein said ground plane is a mesh.

* * * * *